US006098302A

United States Patent [19]

Gilliam

[11] Patent Number: 6,098,302

[45] Date of Patent: Aug. 8, 2000

[54] RAFTER TEMPLATE

[75] Inventor: Edgar T. Gilliam, Franklinton, N.C.

[73] Assignee: Cooper Industries, Inc., Houston, Tex.

[21] Appl. No.: 09/159,195

[22] Filed: Sep. 23, 1998

[51] Int. Cl.[7] ..... G01B 3/14

[52] U.S. Cl. ..... 33/562; 33/416; 33/481

[58] Field of Search ..... 33/415, 416, 417, 33/481, 474, 562

[56] References Cited

U.S. PATENT DOCUMENTS

| | | | |
|---|---|---|---|
| D. 290,092 | 6/1987 | Bies | D10/65 |
| 348,723 | 9/1886 | Conlee | 33/416 |
| 695,339 | 3/1902 | Pettit | 33/416 |
| 885,284 | 4/1908 | Pentecost | 33/416 |
| 918,130 | 4/1909 | Cramner | 33/416 |
| 1,007,539 | 11/1911 | Criss | 33/474 |
| 1,125,010 | 1/1915 | Doner | 33/481 |
| 2,965,969 | 12/1960 | Haley | 33/481 |
| 3,010,209 | 11/1961 | McKinley | 33/481 |
| 3,183,596 | 5/1965 | Shaw | 33/481 |
| 3,378,928 | 4/1968 | Hawkins | 33/474 |
| 4,200,990 | 5/1980 | West | 33/476 |
| 4,651,434 | 3/1987 | Haynes | 33/481 |

FOREIGN PATENT DOCUMENTS

| | | |
|---|---|---|
| 404013576 | 1/1992 | Japan . |

*Primary Examiner*—Diego Gutierrez
*Assistant Examiner*—Yaritza Guadalupe
*Attorney, Agent, or Firm*—Coats & Bennett, P.L.L.C.

[57] ABSTRACT

A template system for rafters for roof construction includes a plurality of individual templates, each dedicated to a single roof pitch. Each template is formed from a plastic material to have a base and a flange attached to the base by a living hinge formed in the plastic material. The flange allows convenience in positioning the template on a rafter stock in a position best suited to the user's own position. The edges of the template are oriented relative to the hinge to provide marking guides for various cuts for common, valley, hip, and jack rafters.

9 Claims, 2 Drawing Sheets

RAFTER TEMPLATE

BACKGROUND AND SUMMARY OF THE INVENTION

The invention is directed to a template system for marking rafters for roof construction. Determining the cuts for rafters can be a complicated and time-consuming chore. One problem, for some people, is that it is difficult to visualize a roof pitch and the correct angles for the cuts on the rafters, making layout of the cuts difficult, even after the appropriate angles are determined.

Templates for rafters have been proposed, but tend to be complicated to use, for some cuts requiring several steps of manipulating the template for marking a single cut line. Another problem in the art is including a wide range of roof pitches on a single template, which limits the number of different types of cuts that can be accommodated on the template.

The present invention provides a template system for roof rafters that eliminates problems in the art with a template that is simple to understand and use. The system includes a plurality of templates, each having cut guides corresponding to a single roof pitch.

Each template includes a base portion with a hinged flange. Preferably, the template is formed from a translucent, plastic material with the hinge formed in the plastic material as a living hinge. The flange is pivotable in both a front and a rear direction relative to the base, and can thus be positioned perpendicular to the base from either front or rear. The user can conveniently position the template at either end of a rafter and on either side, simplifying the marking process. Further, the adaptability of the template allows the user to position the template in a way in which visualizing the cut on the rafter is easiest, which both facilitates using the template and reduces the potential for error.

The template is placed on a rafter stock with the flange on the upper surface and the base on the side surface of the rafter. The outer edges of the template define various cuts for marking on the rafter stock, including one edge for a common rafter plumb cut and a second edge for hip and valley rafter plumb and heel cuts.

The template also includes indications for marking the measuring lines of a 2×4 rafter and a 2×6 rafter. A bottom edge of the template includes a "birds mouth" notch for marking the seat and heel cuts for a 2×6 common rafter. A triangular hole in the base has edges defining a seat cut and a heel cut for a common 2×4 rafter.

An indicator line adjacent the notch at the bottom edge defines a seat cut for a 2×6 hip or valley rafter. For ease of marking, a small notch may be provided at the end of the indicator line, or more preferably, a slot may be provided coinciding with the indicator line. Alternatively, the indicator line may be formed as a hinge providing a pivotably wing alongside the notch. The wing includes one edge defining the seat cut edge of the notch, and is positionable parallel with the base for marking the 2×6 common rafter seat cut. The wing is pivotable to perpendicular to the base, so that the hinge line can be used for marking the seat cut for a 2×6 hip or valley rafter.

A second indicator line is provided adjacent the hole for a seat cut for a 2×4 hip or valley rafter. A slot may also be provided coincident with the second indicator line for ease of marking. The second indicator line may also be formed as a hinge to provide a pivotable flap adjacent to the triangular hole, with one edge of the flap forming the edge defining the seat cut for a common 2×4 rafter, and the hinge line defining the seat cut for a 2×4 hip or valley rafter.

A template according to the invention includes a second hinge in the base portion to allow folding the template in half for convenient storage in a tool pouch.

BRIEF DESCRIPTION OF THE DRAWINGS

The invention will be better understood by reference to the following detailed description in conjunction with the appended drawings, in which.

DETAILED DESCRIPTION

Figure 1:
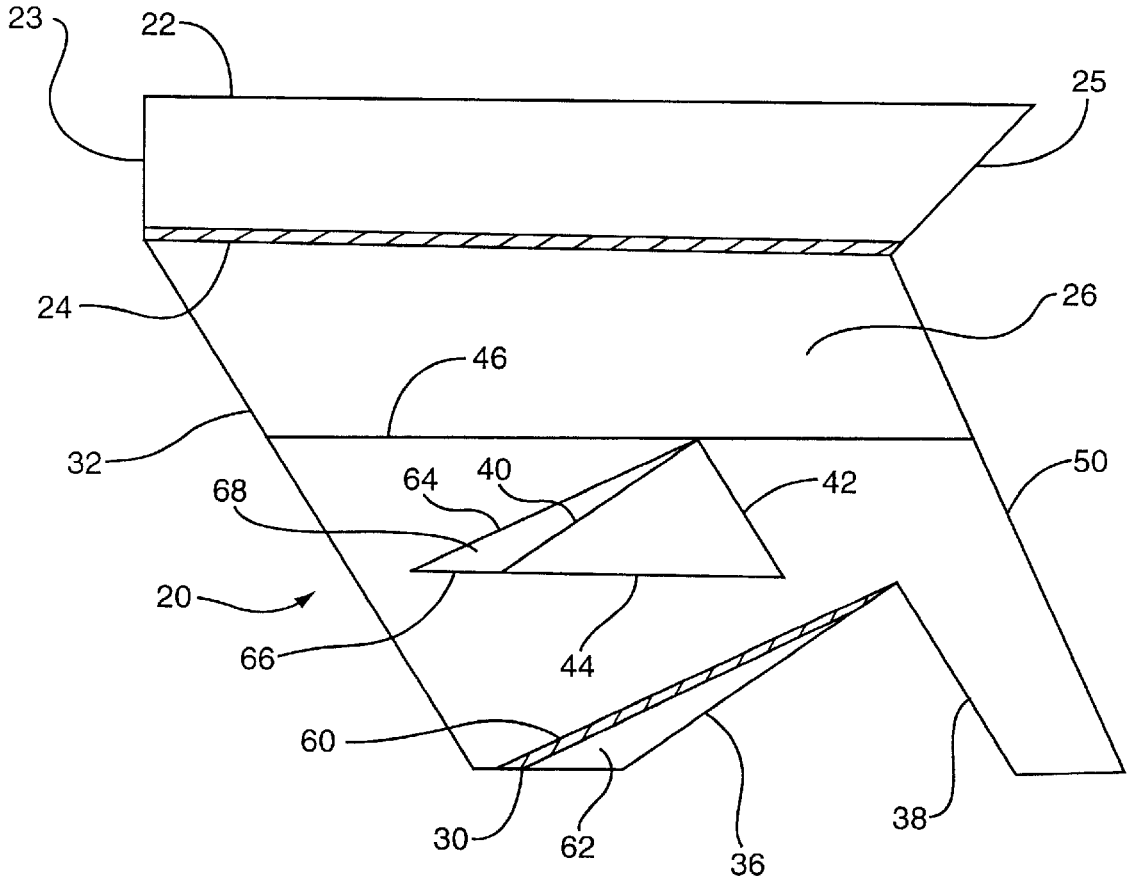
FIG. 1 is a top view of a template in accordance with the invention.

FIG. 1 illustrates a template in accordance with the invention shown in a planar configuration. The template is preferably formed from a sheet of translucent or transparent plastic material, which allows viewing the underlying rafter for accuracy in marking. The template includes a base 20 and a flange 22 attached to the base by a longitudinally extending hinge 24. The hinge 24 is conveniently formed as a living hinge by deformation of the plastic sheet material. The hinge 24 forms a longitudinal reference as it is always positioned on a longitudinally extending edge of a rafter.

Figure 2:
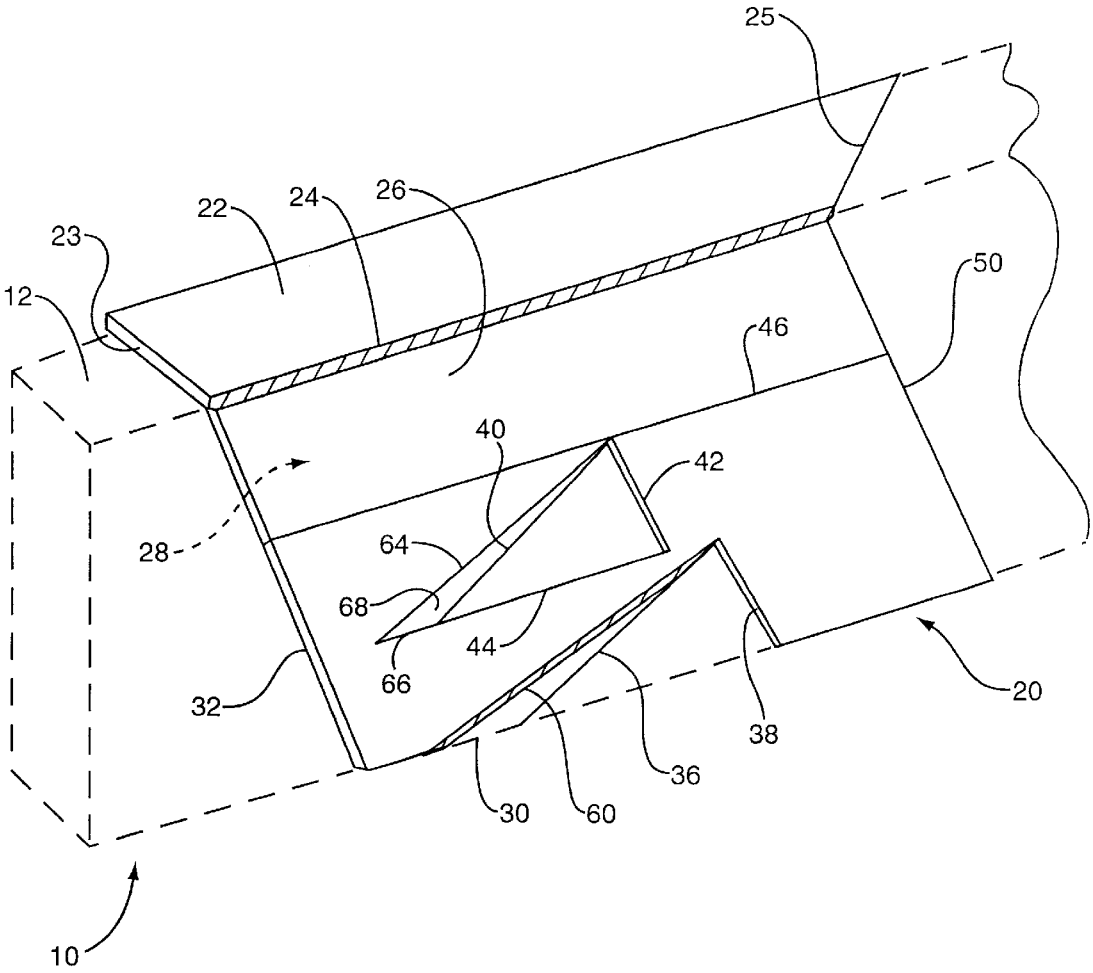
FIG. 2 is a perspective view of the template shown in a marking position on a rafter (shown in ghosted line).

The hinge 24 allows the flange 22 to be pivoted from the planar position shown in FIG. 1 to a position perpendicular to the base 20, as shown in FIG. 2. The flange 22 can be positioned on a top or bottom surface of a rafter, with the base 20 positioned on the side surface. In FIG. 2, the flange 22 is shown bent toward a rear surface 28 of the template and positioned on the top 12 of the rafter 10. The hinge 24 also advantageously allows the flange 22 to be bent in the opposite direction, that is toward a front surface 26 of the template. The hinge 24 conveniently allows the template to be adapted to the relative positions the user and the rafter are in, that is, the user can be standing at either end of a rafter, and on either side, and can fold and position the template on the rafter in the most convenient position for best seeing where the cut is to be made.

The template includes a plurality of edges oriented relative to the hinge 24 to correspond with various cuts for common, hip, valley, and jack rafters. The various rafters discussed below are understood to have the meanings as generally used in the building art. According to the invention, a template is formed for a single roof pitch for simplicity and ease in using a template. The system according to the invention includes a plurality of templates, each corresponding to a common roof pitch. In addition, the base 20 has a width from the hinge 24 to a bottom edge 30 that can accommodate a 2×4 or a 2×6 rafter. The template can be used for a 2×8 rafter by extending the marking lines for the 2×6 size.

A first end edge 32 of the base 20 is oriented to correspond to a plumb cut made on both ends of a common rafter. A first edge 23 of the flange 22 is oriented for marking the top of the common rafter.

A notch, defined by first notch edge 36 and second notch edge 38, is formed in the bottom edge 30 and provides guides for a seat cut (first edge 36) and heel cut (second edge 38) for a 2×6 common rafter.

The base 20 includes a triangular hole, defined by first edge 40, second edge 42, and bottom edge 44, to provide cutting guides for a seat cut (first edge 40) and heel cut (second edge 42) for a 2×4 rafter. The bottom edge 44 corresponds to a length measuring line for a 2×6 rafter, and a line 46 at the top of the triangular hole indicates the length measuring line for a 2×4 rafter.

A second end edge 50, opposite the first end edge 32, is oriented for the plumb cut and heel cut for hip and valley rafters. Hip and valley rafters are given a plumb cut at both ends, as are common rafters. In addition, however, the top end faces of hip and valley rafters must also be cut at 45° to mate with the ridge board. The valley rafter is typically cut with a bevel to mate with both the main ridge board and a gable or dormer ridge board. A second edge 25 of the flange 22 is at 45° to the longitudinal hinge 24 for marking the face cuts of the ends of the hip and valley rafters.

The template can easily provide the marks for a valley bevel cut without measuring the midpoint of the rafter. The flange 22 is folded in one direction and placed on a valley rafter. Marks are made on the first side (using edge 50) and the top side (using edge 25). The flange is then folded in the opposite direction and positioned on the opposite side of the rafter, and the side mark and an additional top mark are made. The intersection of the top marks shows the leading edge of the bevel.

An indicator line 60 adjacent to the first edge 36 of the notch indicates the seat cut for a 2×6 hip or valley rafter. A mark can be made using the ends of the indicator 60 at the bottom edge and the intersection of the notch edges 36 and 38. Alternatively, a slot can be provided along the indicator line 60 for marking through the template. According to another embodiment, the indicator line 60 can be formed a hinge defining a wing 62 that can be positioned planar for marking the common rafter seat cut with edge 36, or bent upward to allow use of the hinge line 60 for marking the seat cut for the 2×6 hip or valley rafter.

Similarly, a second indicator line 64 is provided adjacent to the first edge 40 of the triangular hole for marking the seat cut for a 2×4 hip or valley rafter. A slot can also be provided along the second indicator line 64 for guiding a marking pencil. Alternatively, the second indicator line 64 can also be formed as a hinge, with an additional cut 66 made from the end of the second indicator line 64 to the bottom edge 44 of the triangular hole, to define a flap 68. The flap 68 can be positioned planar with the base 20 for using the first hole edge 40, or bent up for using the hinge line 64, for marking the desired cut, as explained above.

A second hinge can be formed in the base, conveniently along the measuring line 46, to allow the template to be folded in half for storage in a tool pouch.

The template according to the invention provides a tool that is simple to use, in part because the shape of the template aids in visualizing the cuts to be made. Roof pitch is the ratio of the rise of the roof to the horizontal span, and is typically expressed as inches per one foot of span. This can be difficult to visualize, but by positioning the template with the common rafter plumb edge, first edge 32 vertically, the flange 22 will show the roof pitch. A user with a set of template according to the invention can view a variety of templates to find a desirable roof pitch.

In addition, the template can be used for setting the angle of a miter saw or radial arm saw without the need convert pitch into degrees. As saws do not usually include pitch scales, this function eliminates a step in cutting a rafter with miter or radial arm saws.

The invention has been described in terms of preferred features and embodiments, however, the invention is not intended to be limited to the literal embodiments described herein. Those skilled in the art will understand that changes, variations, and substitutions can be made without departing from the spirit and scope of the following claims.

What I claim is:

1. A rafter template for cutting rafters for a single roof pitch, comprising a planar base and a planar flange attached to the base with a longitudinally extending hinge, the flange being pivotable between at least a position parallel to the base and a position perpendicular to the base, the base having a first end edge defining a common rafter plumb cut and a second end edge defining hip and valley rafter plumb cuts, a bottom edge of the base having a triangular notch with a first notch edge defining common rafter seat cut and a second notch edge defining a common rafter heel cut, and the flange having a first end edge perpendicular to the hinge and a second end edge at 45° to the hinge.

2. The template as claimed in claim 1, wherein the flange is pivotable between mutually opposite positions perpendicular to the base.

3. The template as claimed in claim 1, further comprising an indication on the base defining a seat cut for a hip or valley rafter.

4. The template as claimed in claim 1, wherein a wing having a first edge is hingeably attached to the base at the triangular notch in the bottom edge via a second hinge, said first edge of the wing being the first notch edge and said second hinge defining a hip or valley seat cut, wherein the wing is positionable parallel to the base for making a common rafter seat cut and pivotable about said second hinge away from the base for using the hinge edge for making a hip or valley seat cut.

5. The template as claimed in claim 1, wherein edges of the notch define a seat cut and heel cut for a 2×6 common rafter and the template further comprising a triangular hole in the base between the bottom edge and the hinge, a first hole edge defining a seat cut for a 2×4 common rafter and a second hole edge defining a heel cut for a 2×4 common rafter.

6. The template as claimed in claim 5, wherein the base includes an indication adjacent to the hole defining a seat cut for a hip or valley rafter.

7. The template as claimed in claim 5, wherein the base includes a flap formed adjacent to the triangular hole and including the first hole edge, the flap having a hinge defining a seat cut for a 2×4 hip or valley rafter, the flap being pivotable between a position for selectively using the first hole edge and the flap hinge for marking a cut.

8. The template as claimed in claim 1, further comprising indications for marking the measuring line of a 2×4 rafter and the measuring line of a 2×6 rafter.

9. A rafter template system for cutting rafters, comprising a plurality of templates, each having a planar base and a planar flange attached to the base with a longitudinally extending hinge, the flange being pivotable between at least a position parallel to the base and a position perpendicular to the base, the base having a first end edge defining a common rafter plumb cut and a second end edge defining hip and valley plumb cuts, a bottom edge of the base having a triangular notch with a first notch edge defining common rafter seat cut and a second notch edge defining a common rafter heel cut, and the flange having a first end edge perpendicular to the hinge and a second end edge at 45° to the hinge, wherein each template has edges defining cuts corresponding to a single roof pitch.

* * * * *